US005513663A

United States Patent [19]

Van Leuven et al.

[11] Patent Number: 5,513,663

[45] Date of Patent: May 7, 1996

[54] NEW TOBACCO SUBSTITUTES

[76] Inventors: Dirk-Hector Van Leuven; Carmen Deltour, both of Diestsesteenweg 29, B-3210 Linden, Belgium

[21] Appl. No.: 244,890

[22] PCT Filed: Dec. 16, 1992

[86] PCT No.: PCT/NL92/00229

§ 371 Date: Jun. 17, 1994

§ 102(e) Date: Jun. 17, 1994

[87] PCT Pub. No.: WO93/11676

PCT Pub. Date: Jun. 24, 1993

[30] Foreign Application Priority Data

Dec. 17, 1991 [NL] Netherlands ..... 9102102

[51] Int. Cl.[6] ..... A24B 15/00

[52] U.S. Cl. ..... 134/359; 131/352

[58] Field of Search ..... 131/359, 352

[56] References Cited

U.S. PATENT DOCUMENTS 2,930,719 3/1960 Finberg .

4,933,177 6/1990 Grollier et al. ..... 424/74

FOREIGN PATENT DOCUMENTS 1184756 4/1985 Canada .

*Primary Examiner*—James J. Seidleck
*Assistant Examiner*—Duc Truong
*Attorney, Agent, or Firm*—Beveridge, DeGrandi, Weilacher & Young

[57] ABSTRACT

Plant parts used as tobacco substitute in smoking compositions and in smoking substitutes originate from *Alchemilla vulgaris* and/or *Myrtus communis*. Mixtures containing 60–99.9% by weight of *Alchemilla vulgaris* or *Myrtus communis* are preferred. The mixture may include up to 50% by weight of one or more types of aromatic plants which are preferably selected from the group *Asperula odorata, Mentha piperita, Salvia officinalis, Thymus vulgaris* and *Eucalyptus globulus*, and/or extracts thereof and/or synthetic equivalent aromatic substances and/or flavorings.

20 Claims, No Drawings

NEW TOBACCO SUBSTITUTES

The present invention relates to mixtures of certain planes and their use as tobacco substitute in smoking compositions and in smoking substitutes, and to smoking compositions produced with such tobacco substitutes.

The smoking of tobacco and of products based on tobacco is an old habit, of which the risks and damages become more and more public. At the moment it is generally believed that the smoking of tobacco and tobacco compositions is harmful to your health. In a number of countries it is therefore even required to place a warning on such products. Further it is not recommended to smoke tobacco and tobacco compositions, or not even allowed by the doctor attending the patient, with various disorders. Moreover, the regularly smoking of tobacco leads to a more or less great affection or even addiction, which on the one hand is caused by the nicotine in the tobacco, and on the other hand by the recalled primary sucking reflex which gives a secure feeling. Consequently, when quitting the smoking of tobacco, the withdrawal symptoms are both of a physical and physiological nature. However, it seems to be more difficult to endure the psychological withdrawal than the loss of nicotine, since the dependency on nicotine usually no longer exists after an average habit period of ten days.

Therefore it seems logical to substitute tobacco by nicotine-free tobacco substitutes. Certain plants, preferably dried and shredded in an appropriate manner, are known as tobacco substitutes. Examples thereof are described in the collection "Les Plantes Fumables" (1978) by Alain Saury, published by Maloine S. A., Paris.

A disadvantage of the existing tobacco substitutes based on plants, is that the thus proposed substitutes generally give an unpleasant taste or an unpleasant aroma or often both. Furthermore, they were not experienced as actual substitutes of tobacco, so that the consumers fell back on the smoking of tobacco compositions after a shorter or longer period. Even in the above-mentioned collection "Les Plantes Fumables" quite a number of examples of compositions still contains a percentage of tobacco.

The present invention relates to the use of certain plants, viz. mixtures containing *Alchemilla vulgaris* and *Myrtus communis* as tobacco substitutes, particularly in smoking compositions. Surprisingly, it appeared that the consumers experienced these compositions as satisfactory tobacco substitutes, and this without observing the previous disadvantages such as unpleasant taste or aroma. Another advantage of using the tobacco substitutes of the present invention regards the fact that these substitutes do not contain nicotine and that the tar content of the smoke is considerably lower than with tobacco. Another particular advantage is that when tobacco substitutes according to the present invention are used, the smoker, e.g. after smoking one or more smoke rolls produced of the aforementioned plane mixtures of *Alchemilla vulgaris* and *Myrtus communis*, experiences the smoking of common or tobacco-based smoking compositions as unpleasant. The smoking of tobacco compositions is then accompanied by a distorted and unpleasant taste which is observed for hours, and up to 24 hours or longer.

Consequently, the present invention involves plant mixtures containing *Alchemilla vulgaris* and *Myrtus communis* and the use thereof as tobacco substitutes, particularly in smoking compositions. More specifically, the aforementioned mixtures will consist of the leaves of said plants, which leaves are preferably dried in a conventional manner. A further aspect of the present invention comprises smoking compositions prepared from the aforementioned plant mixtures.

The term "tobacco substitute" as used above particularly aims at products used in smoking compositions which, as far as taste and aroma are concerned, may be considered as satisfactory tobacco substitutes. Smoking compositions may be cigarettes, cigars, and smoking compositions to be used in pipes or to roll cigarettes.

*Alchemilla vulgaris* and *Myrtus communis* are preferably used in dried condition and shredded appropiately. After gathering plant pares of *Alchemilla vulgaris* and *Myrtus communis*, preferably the leaves, these are dried in a conventional manner, e.g. In well ventilated drying chambers at room temperature and preferably for several days, wherein the duration of the drying period depends on the plant, the humidity of the material to be dried and the humidity of the air. Afterwards the material is shredded in a conventional manner, for instance by putting the dried plant parts on top of one another and shredding them, or in any conventional manner for shredding tobacco, and are subsequently processed to e.g. smoke rolls similar to cigars and cigarettes. When mixtures are used, mixtures of dried plane pares and more in particular leaves are shredded, although it is also possible to mix the shredded plant material in a conventional manner.

The term "smoke roll" which is mentioned above and will be mentioned hereinafter, aims at smoking compositions similar to cigars or cigarettes in which the tobacco is replaced by a tobacco substitute, or a mixture thereof containing tobacco.

Mixtures of *Alchemilla vulgaris* and *Myrtus communis* substantially containing *Alchemilla vulgaris* give smoking compositions which are experienced as light ("blond" or also called "light"). When using pure or a high content of *Alchemilla vulgaris*, smoking compositions are obtained which are experienced as very light ("ultra light"). The same applies to tobacco mixed with the aforementioned mixtures of *Alchemilla vulgaris* and *Myrtus communis*, wherein the tobacco used should naturally be light. For example, smoke rolls produced with the aforementioned mixture may be compared with light cigarettes. Such mixtures which are experienced as "light" preferably contain more than 60% and more preferably 70–80% by weight of *Alchemilla vulgaris*. A typical mixture contains 75% by weight of *Alchemilla vulgaris* and 25% by weight of *Myrtus communis*. The more *Alchemilla vulgaris* is present in the mixture, the more the smoking compositions produced therewith are experienced as light. Such mixtures contain e.g. more than 70%, more than 80% or optionally more than 90% by weight of *Alchemilla vulgaris*. When using pure *Alchemilla vulgaris*, tobacco substitutes are obtained which are experienced as extremely light.

Mixtures of *Alchemilla vulgaris* and *Myrtus communis* substantially containing *Myrtus communis* give smoking compositions which are experienced as rather strong, particularly when using pure *Myrtus communis*. Pure *Myrtus communis* or mixtures substantially containing *Myrtus communis* may be used to produce so-called "strong" smoking compositions, e.g. smoke rolls which can be compared with rather strong cigarettes. In addition, tobacco, preferably strong tobacco, can again be mixed with mixtures of *Alchemilla vulgaris* and *Myrtus communis* substantially containing *Myrtus communis* or with pure *Myrtus communis*, this to obtain mixtures to be used in smoking compositions which are experienced as "strong". Such mixtures which are experienced as "strong" preferably contain more than 60% and more preferably 70–80% by weight of *Myrtus communis*. A typical mixture contains 75% by weight of *Myrtus communis* and 25% by weight of *Alchemilla vulgaris*. The more *Myrtus communis* is present in the mixture, the more the smoking compositions produced therewith are experienced as strong. Such mixtures contain e.g. more than 70%, more than 80% or optionally more than 90% by weight of *Myrtus communis*. Using pure *Myrtus communis* gives tobacco substitutes, which are experienced as quite strong. Therefore, a further aspect of the present invention is the use of *Alchemilla vulgaris* or *Myrtus communis* as tobacco substitute, wherein either *Alchemilla vulgaris* of *Myrtus communis* can be used as such. Preferably, the leaves of *Alchemilla vulgaris* or *Myrtus communis*, more specifically dried and shredded, are used as tobacco substitutes, particulary in smoking compositions.

*Alchemilla vulgaris* and *Myrtus communis* may further be used to reduce the tobacco content of smoking compositions by mixing an amount of *Alchemilla vulgaris* or *Myrtus communis* or an amount of mixtures of *Alchemilla vulgaris* and *Myrtus communis* with tobacco. So, mixtures of *Alchemilla vulgaris* and/or *Myrtus communis* with tobacco are also subject matter of the present invention.

The taste and/or aroma of the thus produced tobacco substitutes may be further adapted by adding smaller or greater amounts of aromatic planes, extracts thereof and/or optional synthetic equivalent taste and/or aromatic substances, all of which are hereinafter referred to as aromatics, preferably one, two, three or more aromatics selected from the group consisting of *Asperula odorata, Mentha piperita, Salvia officinalis, Thymus vulgaris, Eucalyptus globulus*, and/or optionally others. The addition of aromatics serves, for example, no intensity the light or strong character of the tobacco substitutes, to refine and/or refresh the aroma and/or flavour, to approach the aroma and/or flavour of tobacco, to intensify the above-mentioned unpleasant flavour observed during the smoking of tobacco-based smoking compositions after using tobacco substitutes according to the present invention, and/or to lengthen the effect thereof.

Each of the aforementioned aromatics my be added separately, e.g. just *Asperula odorata* or just *Mentha piperita*, or in combination e.g. *Asperula odorata* and *Mentha piperita, Asperula odorata* and *Salvia officinalis*, to each of the mixtures according to the present invention, and also to just *Alchemilla vulgaris* or *Myrtus communis* so that mixtures of *Alchemilla vulgaris* and *Asperula odorata, Myrtus communis* and *Asperula odorata, Alchemilla vulgaris* and *Asperula odorata* and *Mentha piperita, Myrtus communis* and *Asperula odorata* and *Mentha piperita*, etc . . . are obtained.

The amounts of aromatics which may optionally be added depend e.g. on the origin of the used plane or plants, the concentration of the extracts or of the synthetic equivalents, and on the object aimed an, wherein on the one hand the amount of each of the used aromatics preferably will not exceed an amount equivalent to a weight percentage of dried plant pares of 25% by weight or 20% by weight, or in some cases 15% or even 10% by weight in the tobacco substitutes according to the present invention. The aromatics may even be added in small amounts, e.g. the minimum amount may correspond with a weight percentage of dried plant parts of 1% or 0.5% or even 0.1% by weight. On the other hand, the total amount of the used aromatics will preferably not exceed an amount equivalent to a weight percentage of dried plant parts of 50% by weight, or 40% by weight or in some cases 30% by weight in the tobacco substitutes according to the present invention.

The tobacco substitutes according no the present invention may for instance also be used for producing products which help people to quit using tobacco, e.g. In anti-tobacco chewinggum or candy, or in a mouth spray. To this end, the tobacco substitutes according to the invention are e.g. milled to a powder and then mixed with the raw materials for making chewinggum, candy or sprays. Alternatively the tobacco substitutes, whether or not shredded or milled, may be extracted with e.g. ethanol or ether and the extract may be evaporated and/or freeze-dried and subsequently processed in e.g. chewinggums. Also the synthetic equivalent aromatic substances and/or flavourings may be used in such products. A further alternative may be the use of a condensate of the pyrolysate after removing the tar substances.

EXAMPLE I

The leaves of *Alchemilla vulgaris* were harvested and dried in a well ventilated drying chamber at room temperature. Next, the dried plant parts were processed to a smoke roll, alike a cigarette, in a conventional manner, by rolling the shredded plane material mechanically in cigarette paper and providing it with a filter.

EXAMPLE II 20 test persons, all smokers, were asked to smoke 10 smoke rolls as prepared in Example I. The test persons experienced the smoke rolls as satisfactory substitutes for tobacco cigarettes with a pleasant aroma and flavour.

EXAMPLE III

Smoke rolls based on *Myrtus communis* were produced as described in Example I. Test persons were asked, as in Example II, to smoke such smoke rolls. Here the test persons also experienced the smoke rolls as satisfactory substitutes for tobacco compositions and no bad flavour and/or aroma was noticed.

EXAMPLE IV

A mixture of 75% by weight of *Alchemilla vulgaris* and 25% by weight of *Myrtus communis* was prepared by shredding a mixture of dried leaves of said plants in a conventional manner and processing them to smoke rolls. Tests persons, whom were asked to smoke such smoke rolls, called them satisfactory substitutes for tobacco products without having observed a bad flavour and/or aroma. When the test persons were then asked to smoke tobacco-based cigarettes, they experienced them as unpleasant, and this effect was stronger than when previously the smoke rolls of Example I or III had been smoked.

We claim:

1. A tobacco substitute for use in smoking compositions and in smoking substitutes, characterized in that the composition includes plant parts at least partially originate from the group consisting of *Alchemilla vulgaris* and *Myrtus communis*.

2. A composition according to claim 1 being a mixture of plant parts of *Alchmilla vulgaris* and *Myrtus communis*, wherein the mixture comprises from 60 to 99.9% by weight of *Alchemilla vulgaris*.

3. A composition according to claim 2, wherein the mixture for use in smoking compositions further comprises constituents selected from the group consisting of suitable plant parts of one or more types of aromatic plants (aromatics) and their extracts, synthetic equivalent aromatic substance, and flavorings.

4. A composition according to claim 3, wherein any aromatic used is present in an amount not exceeding the amount equivalent to a weight percentage of 25% by weight of dried plant parts of the corresponding aromatic plants.

5. A composition according to claim 3, wherein the total amount of aromatics present in the mixture does not exceed the amount equivalent to a weight percentage of 50% by weight of dried plant parts of the corresponding aromatic plants.

6. A composition according to claim 5, wherein any aromatic used is present in an amount not exceeding the amount equivalent to a weight percentage of 25% by weight of dried plant parts of the corresponding aromatic plants.

7. A composition according to claim 3, wherein the aromatic plants are selected from the group consisting of *Asperula odorata, Mentha piperita, Salvia officinalis, Thymis vulgaris* and *Eucalyptus globulus.*

8. A composition according to claim 7, wherein the total amount of aromatics present in the mixture does not exceed the amount equivalent to a weight percentage of 50% by weight of dried plant parts of the corresponding aromatic plants.

9. A composition according to claim 8, wherein any aromatic used is present in an amount not exceeding the amount equivalent to a weight percentage of 25% by weight of dried plant parts of the corresponding aromatic plants.

10. A composition according to claim 1 being a mixture of plant parts of *Alchemilla vulgaris* and *Myrtus communis* characterized in that the mixture comprises from 60 to 99.9% by weight of *Myrtus communis.*

11. A composition according to claim 10, wherein the mixture for use in smoking compositions further comprises constituents selected from the group consisting of suitable plant parts of one or more types of aromatic plants (aromatics) and their extracts, synthetic equivalent aromatic substance, and flavorings.

12. A composition according to claim 11, wherein any aromatic used is present in an amount not exceeding the amount equivalent to a weight percentage of 25% by weight of dried plant parts of the corresponding aromatic plants.

13. A composition according to claim 11, wherein the total amount of aromatics present in the mixture does not exceed the amount equivalent to a weight percentage of 50% by weight of dried plant parts of the corresponding aromatic plants.

14. A composition according to claim 13, wherein any aromatic used is present in an amount not exceeding the amount equivalent to a weight percentage of 25% by weight of dried plant parts of the corresponding aromatic plants.

15. A composition according to claim 11, wherein that the aromatic plants are selected from the group consisting of *Asperula odorata, Mentha piperita, Salvia officinalis, Thymis vulgaris* and *Eucalyptus globulus.*

16. A composition according to claim 15, wherein the total amount of aromatics present in the mixture does not exceed the amount equivalent to a weight percentage of 50% by weight of dried plant parts of the corresponding aromatic plants.

17. A composition according to claim 16, wherein any aromatic used is present in an amount not exceeding the amount equivalent to a weight percentage of 25% by weight of dried plant parts of the corresponding aromatic plants.

18. A mixture comprising tobacco and plant parts at least partially originating from the group consisting of *Alchemilla vulgaris* and *Myrtus communis.*

19. Smoking compositions, having a filling which includes plant parts which at least partially originate from the group consisting of *Alchemilla vulgaris* and *Myrtus communis*, extracts of *Alchemilla vulgaris*, extracts of *Myrtus communis*, and synthetic equivalents of said extracts.

20. A smoking composition which can be used as a tobacco substitute and/or product to help people to stop smoking plant parts which at least partially originates from the group consisting of *Alchemilla vulgaris* and *Myrthus communis.*

* * * * *